US006428857B1

(12) United States Patent
Swain et al.

(10) Patent No.: US 6,428,857 B1
(45) Date of Patent: Aug. 6, 2002

(54) METHOD FOR PURGING STAGNANT COATING SOLUTION

(75) Inventors: Eugene A. Swain, Webster; Steven J. Grammatica, Penfield; Christopher R. Fridd, Rochester; Kathryn T. Lalone, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/788,734

(22) Filed: Feb. 20, 2001

(51) Int. Cl.[7] ..... B05D 1/18; B05D 7/22
(52) U.S. Cl. ..... 427/430.1; 427/230
(58) Field of Search ..... 427/430.1, 230; 118/602, 429

(56) References Cited

U.S. PATENT DOCUMENTS 5,217,536 A * 6/1993 Matsumura et al. ..... 118/602
5,279,916 A * 1/1994 Sumino ..... 430/134
5,334,246 A * 8/1994 Pietrzykowski, Jr. et al. . 118/69
5,693,372 A * 12/1997 Mistrater et al. ..... 427/430.1
5,725,667 A * 3/1998 Petropoulos et al. ..... 118/407
6,132,810 A 10/2000 Swain et al. ..... 427/430.1

* cited by examiner

*Primary Examiner*—Michael Barr
(74) *Attorney, Agent, or Firm*—Zosan Soong

(57) ABSTRACT

A method comprising: (a) overflowing a vessel with a coating solution, wherein there is a zone of stagnant coating solution within the vessel; (b) directing at least one fluid jet at the zone of the stagnant coating solution, thereby causing at least a portion of the stagnant coating solution to overflow the vessel; and (c) dip coating a substrate with the coating solution in the vessel, subsequent to the feature (b).

10 Claims, 2 Drawing Sheets

METHOD FOR PURGING STAGNANT COATING SOLUTION

BACKGROUND OF THE INVENTION

The dip coating method has been used to manufacture certain types of photoreceptors. In this dip coating method, a cylindrical substrate is immersed in a vessel containing the solution to be coated; the substrate is then withdrawn at a rate that controls the coating thickness. The vessel also may be cylindrically shaped. The usual procedure used to fill the vessel is to pump a coating solution containing the active materials, either dissolved or in suspension such as pigments, into the vessel from the bottom and continuously overflow the vessel at the top. In this way, the substrate is subjected during dip coating to a uniform flow of coating solution relative to the coating speed.

Conventional dip coating methods and apparatus are deficient in at least one respect. FIG. 1 depicts a conventional dip coating apparatus 2 where the movement of the coating solution is indicated by flow lines 4. As seen in FIG. 1, the coating solution flows from the bottom of the vessel 6 into an overflow container 8 positioned adjacent the vessel. However, a zone 10 of stagnant coating solution is present as indicated by the flow lines around the zone 10 and the absence of flow lines within the zone. The term "stagnant" means no movement of coating solution or relatively little movement. Contaminants (e.g., dirt, chips, and agglomerations) may be present in the zone. Because of the relative surface tension between the substrate 12 and the coating solution, such contaminants near the point of contact of the substrate and the coating solution can be pulled onto the substrate surface during dip coating. There is then a high probability that the contaminants will remain on the substrate after dip coating which can degrade the quality of the dip coated layer.

Thus, there is a need, addressed by the present invention, for new dip coating methods and apparatus which avoid or minimize the above discussed deficiency.

Conventional dip coating methods and apparatus are described in Swain et al., U.S. Pat. No. 6,132,810 and Petropoulos et al., U.S. Pat. No. 5,725,667.

SUMMARY OF THE INVENTION

The present invention is accomplished in embodiments by providing a method comprising:

(a) overflowing a vessel with a coating solution, wherein there is a zone of stagnant coating solution within the vessel;

(b) directing at least one fluid jet at the zone of the stagnant coating solution, thereby causing at least a portion of the stagnant coating solution to overflow the vessel; and (c) dip coating a substrate with the coating solution in the vessel, subsequent to the feature (b).

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
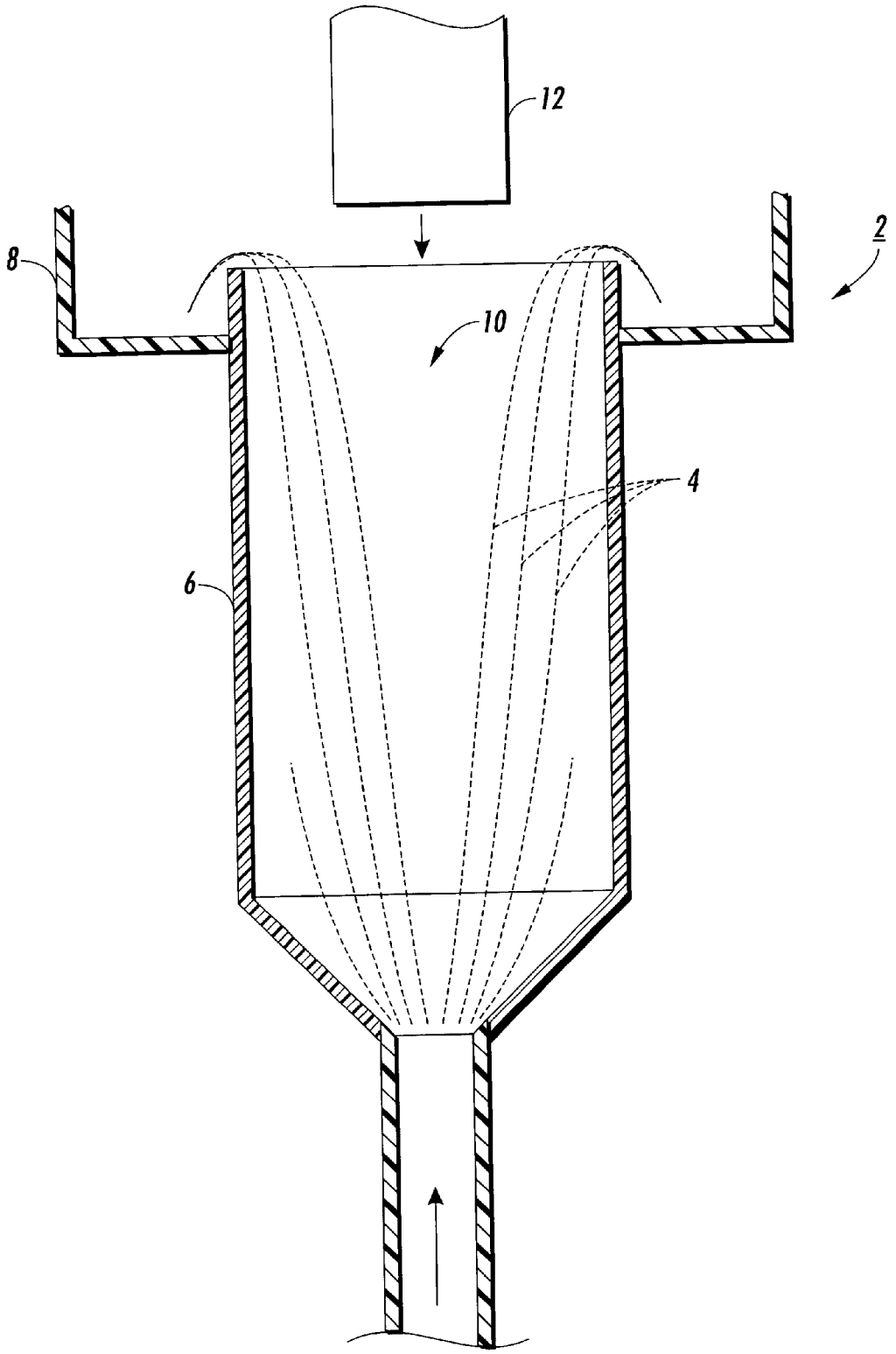
FIG. 1 PRIOR ART
FIG. 1 is a schematic elevational view of a conventional dip coating apparatus.
Figure 2:
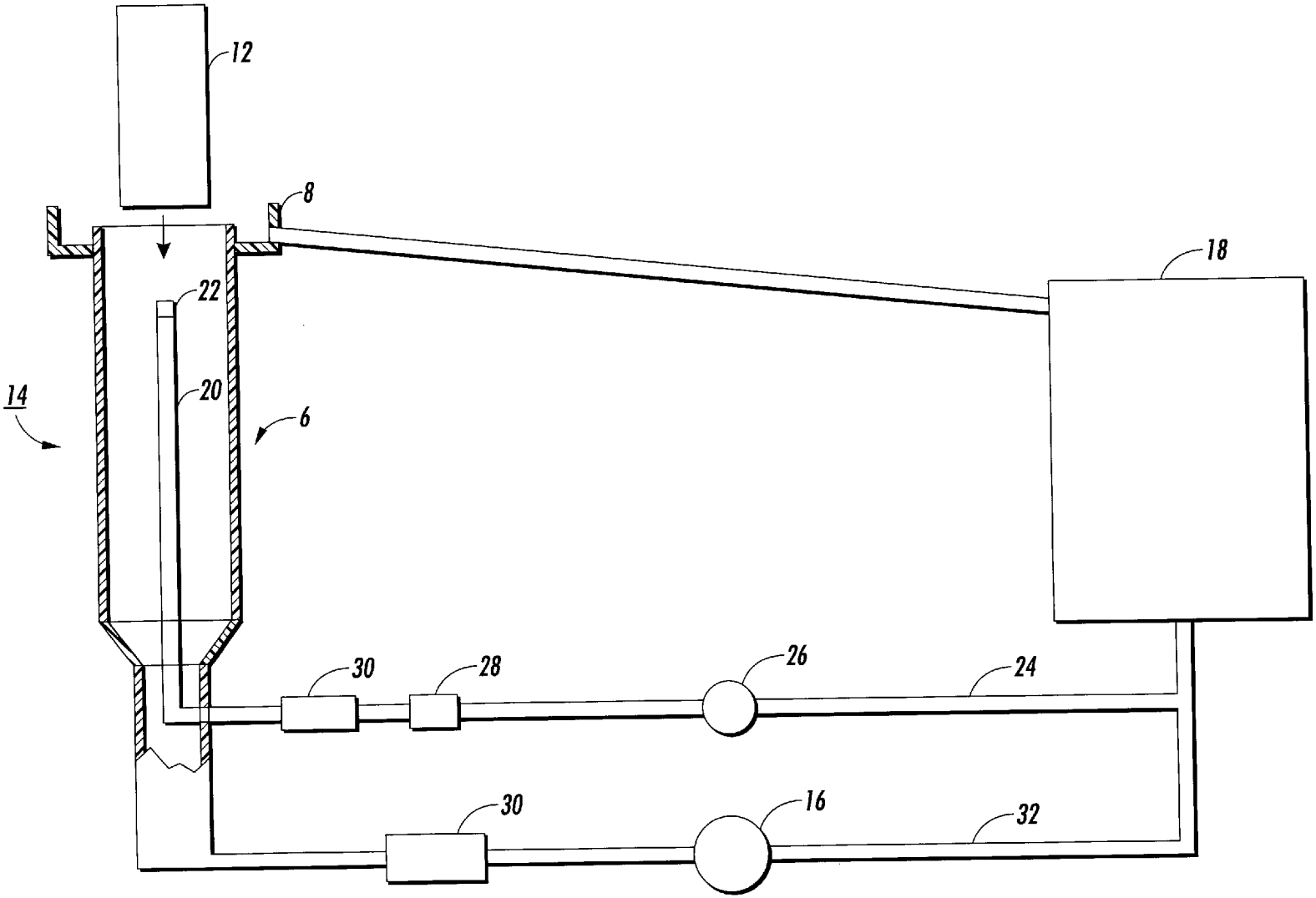
FIG. 2 is a schematic elevational view of one embodiment of the present dip coating apparatus employing the instant method.

FIG. 2 depicts a preferred dip coating apparatus 14 where pump 16 conveys coating solution from the recirculation tank 18 to the bottom of vessel 6. Pump 16 conveys sufficient coating solution into the vessel 6 such that the coating solution overflows the top of the vessel into the adjacent overflow container 8 where the coating solution then flows into the recirculation tank 18. A fluid jet device 20 is placed vertically in the center of the vessel with the orifice 22 disposed below the coating solution surface. The orifice is preferably a nozzle which can be changed or adjusted depending on the width of the vessel. In operation, at least one fluid jet is discharged from the orifice at the zone of stagnant coating solution to cause at least a portion of the stagnant coating solution to overflow the vessel, where the stagnant coating solution is conveyed to the recirculation tank. Since contaminants may be present in the stagnant coating solution, the purpose of the fluid jet or jets is to purge the contaminants from the vessel during the non-coating parts of the manufacturing cycle; when the substrate 12 is being dip coated, the fluid jet is turned off. When the substrate clears the surface of the coating solution, the fluid jet is turned on to purge the contaminants from the coating solution used to dip coat the substrate. The fluid jet device 20 is preferably connected to the recirculation tank 18 where the supply tubing 24 contains a pump 26 and valve 28 to control the flow rate and the on and off function.

The fluid jet device can emit a single fluid jet or a plurality of fluid jets such as 2 to 20, or more. The fluid jet device may include a single tube or a plurality of tubes such as 2 to 20, or more, each tube emitting a fluid jet. In embodiments, a nozzle can emit a plurality of fluid jets.

Filters 30 are preferably disposed in the supply tubing 24 for the fluid jet device and in the supply tubing 32 for the vessel to filter out any contaminants from the coating solution conveyed from the recirculation tank, thereby providing filtered coating solution to the fluid jet device and the vessel. In other embodiments, however, "recirculated" coating solution is not used; rather, fresh coating solution may be fed to the fluid jet device and the vessel.

In embodiments, the fluid jet device emits 3 to 10 fluid jets, preferably 4 to 6 fluid jets. The angle of these fluid jets is preferably from 0 degrees to about 60 degrees from vertical, more preferably from about 5 to about 25 degrees for a small diameter vessel (40 mm to 60 mm), and most preferably from about 5 to about 45 degrees for a larger diameter vessel (60 mm to 160 mm). The velocity of these fluid jets is preferably from about 0.25 to about 3.0 feet per second, more preferably from about 0.5 to about 1.5 feet per second. In embodiments, the distance below the surface of the coating solution can vary from about 1 inch to about 6 inches, more preferably from about 2.5 inches to about 4.0 inches. In all cases, the fluid jet or jets must not interfere with the chuck or holding device on which the substrate is mounted. The diameter and depth of the stagnant zone of the coating solution is dependent on the rate of flow of the incoming coating solution into the bottom of the vessel. Therefore, the size and shape of the fluid jet or jets have to be tailored to the shape of the stagnant zone. The most efficient method to accomplish this is through trial and error. The purge time may vary depending on the length of the coating cycle. In one embodiment, the fluid jet or jets can be activated immediately after the bottom of the substrate leaves the coating solution and remain active until five seconds before the next substrate enters the solution. Lesser times may also be effective depending on the contamination level of the coating solution.

The fluid used for the fluid jet device may be any liquid or gas that does not appreciably degrade the quality of the resulting dip coated layer. For example, the fluid for the fluid jet device may be the same coating solution used for dip coating or a variation of the coating solution such as one having different material proportions. Moreover, the fluid for the fluid jet device may be a component or components of the coating solution such as the solvent. Suitable gases include for instance air, nitrogen, helium, argon, and the like. To accommodate the use of a fluid other than the coating solution, the coating apparatus depicted in FIG. 2 could be modified by connecting the fluid jet device 20 to its own fluid supply container rather than to the recirculation tank 18. In embodiments using a gas, the fluid jet device would be connected to a compressed gas supply such as a pressurized gas cylinder or bulk supply tank where a pressure regulator would be inserted into the supply line to regulate the gas pressure.

The phrase "dip coating" encompasses the following techniques to deposit layered material onto a substrate: moving the substrate into and out of the coating solution; and raising and lowering the coating vessel to contact the solution with the substrate.

The substrate may be moved into and out of the solution at any suitable speed including the takeup speed indicated in Yashiki et al., U.S. Pat. No. 4,610,942, the disclosure of which is hereby totally incorporated by reference. The dipping speed during lowering of the substrate may range for example from about 50 to about 1500 mm/min and may be a constant or changing value. The takeup speed during the raising of the substrate may range for example from about 50 to about 500 mm/min and may be a constant or changing value.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness from about 50 Angstroms to about 30 micrometers, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX® 447 (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like.

The substrate and coating solution are described herein as being used in the fabrication of a photoreceptor. However, the present invention is not limited to the fabrication of a photoreceptor. In embodiments, the present invention uses other substrates and coating solutions not specifically described herein which are useful for other applications.

In preferred embodiments, the coating solution may comprise materials typically used for any layer of a photoreceptor including such layers as a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like. In embodiments, the same material can function as an adhesive layer and as a charge blocking layer.

In embodiments, a charge generating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating solution comprises: 2% by weight hydroxy gallium phthalocyanine; 1% by weight terpolymer of vinyl acetate, vinyl chloride, and maleic acid; and 97% by weight cyclohexanone.

In embodiments, a charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4,4'diamine; 14% by weight poly(4,4'-diphenyl-1,1'-cyclohexane carbonate) (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After all the desired layers are coated onto the substrates, they may be subjected to elevated drying temperatures such as from about 100 to about 160° C. for about 0.2 to about 2 hours.

Other modifications of the present invention may occur to those skilled in the art based upon a reading of the present disclosure and these modifications are intended to be included within the scope of the present invention.

We claim:

1. A method comprising:

(a) overflowing a vessel with a coating solution, wherein there is a zone of stagnant coating solution within the vessel;

(b) directing at least one fluid jet at the zone of the stagnant coating solution, thereby causing at least a portion of the stagnant coating solution to overflow the vessel; and (c) dip coating a substrate with the coating solution in the vessel, subsequent to the feature (b).

2. The method of claim 1, wherein the at least one fluid jet includes 2 to 20 fluid jets.

3. The method of claim 1, wherein the fluid jet includes the coating solution.

4. The method of claim 1, wherein the fluid jet includes a gas.

5. The method of claim 1, further comprising filtering both the coating solution that overflowed the vessel in the feature (a) and the portion of the stagnant coating solution that overflowed the vessel in the feature (b) to remove any contaminants, thereby resulting in a filtered coating solution.

6. The method of claim 5, wherein the coating solution in the feature (a) is the filtered coating solution.

7. The method of claim 5, wherein the fluid jet in the feature (b) includes the filtered coating solution.

8. The method of claim 1, wherein the coating solution is a charge transport solution.

9. The method of claim 1, wherein the coating solution is a charge generating solution.

10. The method of claim 1, wherein the substrate is a hollow cylinder open at both ends.

* * * * *